US005158018A

United States Patent [19]

Masaki et al.

[11] Patent Number: 5,158,018

[45] Date of Patent: Oct. 27, 1992

[54] THIN FILM FORMING APPARATUS

[75] Inventors: Kenichi Masaki; Yasuhiro Hashimura, both of Kyoto, Japan

[73] Assignee: Nissha Printing Co., Ltd., Kyoto, Japan

[21] Appl. No.: 730,894

[22] PCT Filed: Apr. 27, 1990

[86] PCT No.: PCT/JP90/00556

§ 371 Date: Jul. 30, 1991

§ 102(e) Date: Jul. 30, 1991

[87] PCT Pub. No.: WO91/17049

PCT Pub. Date: Nov. 14, 1991

[51] Int. Cl.[5] ..... B41F 3/36

[52] U.S. Cl. ..... 101/158; 101/163; 101/1

[58] Field of Search ..... 101/150, 157, 158, 161, 101/169, 170, 212, 250, 152, 153, 158, 163

[56] References Cited

U.S. PATENT DOCUMENTS 4,558,643 12/1985 Arima et al. ..... 101/158
4,841,857 6/1989 Hashimura et al. ..... 101/158
4,989,513 2/1991 Toda et al. ..... 101/158

FOREIGN PATENT DOCUMENTS 2030929 4/1980 European Pat. Off. ..... 101/150
50-13113 2/1975 Japan .
53-43204 10/1978 Japan .
0130386 10/1981 Japan ..... 101/150
58-170864 11/1983 Japan .
62-202736 7/1987 Japan .
62-53347 11/1987 Japan .
2-192944 7/1990 Japan .

*Primary Examiner*—Edgar S. Burr
*Assistant Examiner*—Christopher A. Bennett
*Attorney, Agent, or Firm*—Wenderoth, Lind & Ponack

[57] ABSTRACT

In a thin film forming apparatus, ink is supplied to the recess of a roll-shaped or plate-shaped intaglio (3, 23), the intaglio contacts a projection (4a, 24a) of a printing roll (4, 24), the ink held in the recess of the intaglio is transferred to the projection, the projection of the printing roll contacts a material to be printed (10, 30), and the ink is transferred to the surface of the material. Thus, a thin film is formed. The apparatus has a moving device (16, 7, 65, 36, 39) for moving the roll-shaped or plate-shaped intaglio. After the thin film is formed on the material by the initial printing, the intaglio is moved by a predetermined distance in the direction of the rotary shaft thereof or the direction perpendicular to the direction of the rotary shaft. Then, a thin film smooth on the surface thereof and clear in a pattern edge is formed on the material by a second time printing.

3 Claims, 9 Drawing Sheets

THIN FILM FORMING APPARATUS

TECHNICAL FIELD

The present invention relates to an apparatus for smoothly and accurately forming, on a material to be printed, a thin film smooth and uniform in thickness such as a liquid crystal orientation film, a liquid crystal enclosing seal, a film for insulating a semiconductor element, or a resist.

BACKGROUND ART

Generally, as technique for forming a thin film on a hard material to be printed by printing, lithography offset printing or the like is known. But in the lithography offset printing, usable printing ink needs to be faithfully transferred to a surface plate without being emulsified with dampening water in a great amount. Therefore, usable ink is limited to printing ink having a high viscosity of 80,000–100,000 c.p.s. and a film formed by ink transfer lacks smoothness.

Therefore, a thin film cannot be formed by printing if it is necessary to form a film superior in smoothness by printing ink to be used to form a liquid crystal orientation film or a liquid crystal enclosing seal and having a low viscosity of several tens –30,000 c.p.s.

In order to overcome this issue, the applicant proposed a thin film forming apparatus (Japanese Laid-Open Utility Model Publication No. 58-170864) as shown in FIG. 14. In this apparatus, a flat intaglio 42 having recesses consisting of a great number of small openings and grooves and a material to be printed 43 on which a thin film is to be formed are arranged on a base 41, and a printing roll supporting frame 45 having an ink supply device (not shown) for charging ink having a viscosity of several tens to 30,000 c.p.s. into the recesses of the intaglio 42 and a printing roll 44 having an elastic letterpress 44*a* consisting of rubber or resin is movable between the intaglio 42 and the material 43 with respect to the base 41. A doctor, for scraping off an excessive amount of ink from the recesses of the intaglio 42 is provided on the printing roll supporting frame 45.

In the above-described apparatus, ink is supplied from the ink supply device to the recesses of the intaglio 42; an excessive amount of ink is scraped off with the doctor 46; then, the printing roll 44 is rotated by pressing the printing roll 44 against the intaglio 42; ink in the recesses of the intaglio 42 is applied to the surface of the elastic letterpress 44*a* mounted on the printing roll 44; the printing roll 44 having the ink applied thereto is fed over the material 43; and the ink on the elastic letterpress 44*a* is transferred to the surface of the material 43 while the printing roll 44 is rotating. Thus, a predetermined pattern is formed thereon.

The applicant also proposed a thin film forming apparatus (Japanese Laid-Open Patent Publication No. 62-202736) in which the intaglio 42 for supplying a certain amount of ink to the printing roll 44 is not constituted as a flat plate but as a cylindrical member.

According to these thin film forming apparatuses, ink is transferred to the surface of the material according to the arrangement of the recesses of the intaglio, and the surface of the thin film thus formed has regular projections and recesses called "gravure trace" having a configuration similar to those of the intaglio. That is, when ink charged in the recesses of the intaglio is transferred to the surface of the printing roll, the ink is transferred to the printing roll in conformity with the arrangement of the projections and recesses of the intaglio, and when the ink is transferred to the material, an ink film having projections and recesses in conformity with the arrangement of those of the intaglio is also formed on the material. Ink flattens to some extent on the printing roll and the material but the smoothness of the thin film of ink formed thus has gravure trace and is not preferable.

The pattern of the ink film is formed in correspondence to the pattern of the projection of the printing roll. The gravure trace of the ink film is formed in the pattern edge of the projection and the pattern edge of the ink film transferred to the material is indented due to the gravure trace and lacks linearity.

Such a phenomenon occurs outstandingly when the edge of the pattern is intended to be clear by reducing the contact pressure between the printing roll and the intaglio as well as the material, when the viscosity of ink is a little high, when a gravure screen used to manufacture the intaglio is rough in order to increase a film thickness, or when a fine pattern such as a line or a dot is printed.

It is, therefore, an object of the present invention to resolve the above-described issue and provide a thin film forming apparatus capable of forming, on a material to be printed, a highly accurate thin film smooth and having an edge preferable in linearity by transferring a smooth and uniform ink film to the material.

DISCLOSURE OF THE INVENTION

In order to achieve the above-described object, the present invention is constructed to move the position of an intaglio for supplying a certain amount of ink to a printing roll by a predetermined distance so as not to produce a gravure trace.

That is, a thin film forming apparatus according to the present invention is constructed to comprise:

an intaglio roll rotatably supported by a supporting frame of a base and having a screen having a great number of diagonal or latticed regular recesses on a surface thereof;

a doctor, mounted on the supporting frame at a predetermined position in a periphery of the intaglio roll, for spreading ink supplied to the intaglio roll on the surface of the intaglio roll so that a certain amount of ink is held in the recesses;

a printing roll adjacent to the intaglio roll, rotatably supported by the supporting frame, rotatable in synchronization with the intaglio roll, having a desired pattern, capable of contacting the surface of the intaglio roll, and having a projection to which the ink held in the recesses of the intaglio roll is transferred when the printing roll contacts the surface of the intaglio roll;

a surface plate for placing and retaining a material to be printed thereon and capable of reciprocatively moving on the base synchronously with a peripheral speed of the printing roll between a printing position at which the material contacts the printing roll and a position spaced from the printing roll;

a driving device for driving the intaglio roll and the printing roll;

a surface plate driving device for moving the surface plate between the printing position and the position spaced from the printing roll; and an intaglio roll moving device for moving the intaglio roll by a distance found (y) by the following equation in a printing direction and/or by a distance (x) found by the following equation in a direction perpendicular to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is a pitch of banks of the intaglio roll; n is an integer; $\theta$ is an angle of a screen made on the surface of the intaglio roll between a direction of a rotary shaft of the printing roll and the recesses as well as the banks of the diagonal or latticed screen of the intaglio roll.

Another thin film forming apparatus according to the present invention is constructed to comprise:

a flat intaglio supported on a base and having a screen having a great number of diagonal or latticed regular recesses on a surface thereof;

a doctor, mounted on a supporting frame in a periphery of the intaglio at a predetermined position thereof, for spreading ink supplied to the intaglio on the surface of the intaglio so that a certain amount of ink is held in a recess of the intaglio;

a printing roll rotatably supported on the supporting frame and positioned above the intaglio, having a desired pattern and a projection capable of contacting the intaglio, transferring the ink held in the recess of the intaglio to the projection when the projection contacts the intaglio under pressure while the printing roll is rotating;

a surface plate mounted on the base, placing and retaining a material to be printed thereon so that the projection of the printing roll contacts a surface of the material, and transferring ink present on the projection to the material when the projection contacts the material under pressure while the the printing roll is rotating;

a driving device for rotating and moving the printing roll;

a device for moving the intaglio by a distance (y) found by the following equation in a printing direction and/or by a distance (x) found by the following equation in a direction perpendicular to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is a pitch of banks of the intaglio; n is an integer; $\theta$ is an angle of a screen made on the surface of the intaglio between a direction of a rotary shaft of the printing roll and the recess as well as the banks of the diagonal or latticed screen of the intaglio.

According to the thin film forming apparatus, first, ink is supplied to the surface of a flat or roll-shaped intaglio and an excessive amount of ink is removed by a doctor which slides on the intaglio, and a certain amount of ink is charged into the recess of the intaglio and held therein. If the pattern of the intaglio is of a diagonal screen type, it is as shown in FIG. 3(*a*) which is an enlarged plan view and if the pattern of the intaglio is of a latticed screen pattern type, it is as shown in FIG. 3(*b*) which is an enlarged plan view.

Then, the intaglio and the printing roll contact with each other and the ink charged in the intaglio is transferred to the projection of the printing roll. The printing roll has a projection corresponding to the pattern to be formed on a thin film. At this time, the ink film formed on the projection has a great number of regular projections and recesses of the intaglio, namely, a regular projection/recess configuration in which gravure trace is reproduced.

Then, the printing roll which is rotating presses the material in contact therewith and as a result, the ink on the projection of the printing roll is transferred to the material. At this time, an ink film having regular projections and recesses also is formed with the gravure trace reproduced thereon. The edge of the film is indented, namely, nonlinear. The enlarged plan view of the film formed by using the intaglio shown in FIG. 3(*a*) is shown in FIG. 4(*a*) and that of the film formed by using the intaglio shown in FIG. 3(*b*) is shown in FIG. 4(*b*).

Then, the intaglio is moved by the intaglio roll moving device or the intaglio moving device by a distance (y) found by the following equation in the printing direction (Y-direction) and/or by a distance (x) found by the following equation in the direction perpendicular (X-direction) to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is the pitch of banks of the intaglio; n is an integer; $\theta$ is the angle of a screen made on the surface of the intaglio between the direction of the rotary shaft of the printing roll and recesses as well as banks of the diagonal or latticed screen of the intaglio (refer to FIG. 1(*b*) and FIG. 2(*a*).)

The reason the range of $$\left| \frac{x}{p} \sin\theta \right| \text{or} \left| \frac{y}{p} \cos\theta \right|$$

is from n+1/5 to n+4/5 is described below.

In FIG. 2(*a*) showing the initial printing performed on a material to be printed 62, supposing that $\theta$ is 45°, p=0.1 mm, the X component of p is $0.1 \times \sin 45° = 0.141$ mm the Y component of p is $0.1 \times \cos 45° = 0.141$ mm.

As shown in FIG. 2(*b*), the case is considered in which the intaglio is displaced in X-direction or Y-direction so that the pattern of the trace 61 of the bank of ink 60 transferred to the material is displaced ½ in phase from the initial printing condition shown in FIG. 2(*a*).

The movement amount at this time is expressed as follows:

$$n + \frac{1}{2} = \left| \frac{x}{p} \sin\theta \right| \text{or } n + \frac{1}{2} = \left| \frac{y}{p} \cos\theta \right|$$

-continued $$\text{That is,}\quad x = \left(n + \frac{1}{2}\right) \times 0.1 \times \sqrt{2} = \left(n + \frac{1}{2}\right) \times 0.141$$

$$y = \left(n + \frac{1}{2}\right) \times 0.1 \times \sqrt{2} = \left(n + \frac{1}{2}\right) \times 0.141$$

where n is an arbitrary integer.

$$\text{when}\quad n = 0,\ 0.141 \times \frac{1}{2} = x \text{ or } y$$

$$n = 1,\ 0.141 \times \left(1 + \frac{1}{2}\right) = x \text{ or } y$$

$$n = 2,\ 0.141 \times \left(2 + \frac{1}{2}\right) = x \text{ or } y$$

$$n = i,\ 0.141 \times \left(i + \frac{1}{2}\right) = x \text{ or } y$$

From the above, as shown in FIG. 2(*b*), the trace 61 of the bank is printed at a position displaced in phase by ½, namely, an apparent displacement amount 0.071 mm by moving the intaglio by (x) or (y) with respect to the initial printing condition shown in FIG. 2(*a*) irrespective of the value of (n).

Then, a regular pattern consisting of the portion 61, corresponding to the bank of the intaglio, to which ink is not transferred in a great quantity and the portion 60, corresponding to the recess of the intaglio, to which ink is transferred in a great quantity is compensated by transferring ink to the printing roll and the material 62 while the intaglio is moving. As a result, as shown in FIG. 2(*c*), a printed film preferable in linearity and smooth in its pattern edge can be obtained.

The above $\left|\frac{x}{p}\sin\theta\right|$ or $\left|\frac{y}{p}\cos\theta\right|$ expresses the ratio of the movement amount (x) in X-direction or the movement amount (y) in Y-direction to the X-direction component or the Y-direction component of the bank pitch of the intaglio pattern, namely, the displacement of phase. That is, when $$\left|\frac{x}{p}\sin\theta\right| \text{ or } \left|\frac{y}{p}\cos\theta\right|$$

is an integer, the phases are the same as each other, while $$\left|\frac{x}{p}\sin\theta\right| \text{ or } \left|\frac{y}{p}\cos\theta\right|$$

is n+½, the displacement therebetween s maximum (n is integer).

The reason the range of $$\left|\frac{x}{p}\sin\theta\right| \text{ or } \left|\frac{y}{p}\cos\theta\right|$$

is not less than n+1/5 nor more than n+4/5 is as follows:

$$\text{(1) If } \left|\frac{x}{p}\sin\theta\right| \text{ or } \left|\frac{y}{p}\cos\theta\right|$$

is an integer, compensation effect is not obtained because the phase of the trace 61 of the bank of the intaglio does not change before and after the intaglio moves.

$$\text{(2) If } \left|\frac{x}{p}\sin\theta\right| \text{ or } \left|\frac{y}{p}\cos\theta\right|$$

is less than n+1/5 nor than n+4/5, the compensation effect is low because the displacement amount of the phases is small.

For example, supposing that $\theta=45°$, p=0.1 mm, and $$\left|\frac{x}{p}\sin\theta\right| = n + \frac{1}{10},$$

$$x = \frac{1}{10} \times 0.1 \times \sqrt{2} = 0.014 \text{ mm} \quad (n = 0)$$

That is, in this case, an apparent displacement amount is as small as 0.014 mm, so that the compensation effect is low. FIG. 2(*d*) shows the case in which $$\left|\frac{x}{p}\sin\theta\right| \text{ or}$$

$$\left|\frac{y}{p}\cos\theta\right| \text{ is } n + \frac{1}{10}.$$

Therefore, according to the present invention, a region in which the compensation effect is high is limited in the range of not less than n+1/5 nor more than n+4/5 in the phase difference in pattern between the bank of the intaglio and the recess thereof. The sign of (x) and (y) shows the direction of the movement. If the value of the sign is positive, the direction is normal and if negative, the direction is opposite.

After the intaglio moves, ink is supplied to the intaglio and similarly to the above-described manner, an ink film is formed on the same material to overlap on the ink film formed in the initial printing. Ink transferred in the second time printing is formed as a film in the configuration as shown in FIG. 5(*a*) which is an enlarged view when the intaglio shown in FIG. 3(*a*) is used and in the configuration as shown in FIG. 5(*b*) which is an enlarged view when the intaglio shown in FIG. 3(*b*) is used. The phase of the projections and recesses of the ink film transferred in the second time tends to be reversed to the phase of those of the ink film transferred in the first time and compensates the projections and recesses of the ink film previously formed and edge indentations thereof. The plan view of the thin film formed by using the intaglio of FIG. 3(*a*) and FIG. 3(*b*) are shown in enlarged views of FIG. 6(*a*) and FIG. 6(*b*), respectively. The sectional configuration of the ink film formed in the initial printing and the ink film formed by overprinting is shown in an enlarged view of FIG. 7.

In order to compensate projection/recess of the ink film, films may be formed by overprinting ink more than two times on an ink film previously formed. For example, when ink is overprinted three times, the intaglio is moved in the direction perpendicular to the printing direction by ($\frac{1}{3}$) cosec$\theta$ of the bank pitch of the intaglio.

Thus, a thin film smooth on its surface and clear in the pattern edge is formed on the material.

A similar thin film can be formed by performing the following operation.

First, ink is supplied to the surface of a flat or roll-shaped intaglio, and the doctor which slidably moves on the intaglio removes an excessive amount of ink and a certain amount of ink is charged into the recess of the intaglio and held therein.

Then, the printing roll contacts the intaglio, and the ink charged in the recess of the intaglio is transferred to the projection of the printing roll. This is the initial ink applying operation to the projection of the printing roll. At this time, the ink film transferred to the projection has a large number of regular pattern of projections and recesses of the intaglio, namely, the reproduction of the projections and recesses of the gravure trace.

Then, the intaglio is moved by the intaglio roll moving device or the intaglio moving device by a distance (y) found by the following equation in the printing direction and/or by a distance (x) found by the following equation in the direction perpendicular to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is the pitch of banks of the intaglio; n is an integer; $\theta$ is the angle of a screen made on the surface of the intaglio between the direction of the rotary shaft of the printing roll and the recesses as well as banks of the diagonal or latticed screen of the intaglio.

Then, ink is supplied to the intaglio and similarly to the above-described manner, an ink film is formed on the projection of the printing roll. This is the second time ink applying operation to the projection of the printing roll. The projections and recesses of the ink transferred in the second time tends to be reversed in phase to those of the ink film transferred in the first time and the ink is transferred in the second time to compensate the projections and recesses of the ink film previously formed. In order to compensate projections and recesses of the ink film, ink may be applied to the projection more than two times. For example, when ink is overprinted five times, the intaglio is moved in the direction perpendicular to the printing direction by (1/5) cosec$\theta$ of the bank pitch of the intaglio.

After the ink is applied to the projection plural times as described above, the printing roll contacts the material and as a result, the ink on the printing roll is transferred to the material.

Thus, a thin film smooth on its surface and clear in the pattern edge is formed on the material.

A similar thin film can be formed by performing the following operation.

First, ink is supplied to the surface of a flat or roll-shaped intaglio, and the doctor which slidably moves on the intaglio removes an excessive amount of ink and a certain amount of ink is charged into the recess of the intaglio and held therein.

Then, the printing roll contacts the intaglio, and the ink charged in the recess of the intaglio is transferred to the projection of the printing roll. At this time, the ink film on the projection has a large number of regular pattern of projections and recesses of the intaglio, namely, the reproduction of the projections and recesses of the gravure trace.

Thereafter, the printing roll is brought into contact with the material under pressure while the printing roll is rotating and as a result, the ink on the projection of the printing roll is transferred to the material. At this time, all ink on the projection of the printing roll is not transferred to the material, but some amount of ink on the projection remains on the projection. Gravure trace is reproduced on the ink film which has remained on the projection and the ink film ha projections and recesses. The edge of the film is intended or nonlinear. The ink film formed on the material has the gravure trace and unsmooth. Therefore, this ink film is for test and should be thrown away.

Then, the intaglio is moved by the intaglio roll moving device or the intaglio moving device by a distance (y) found by the following equation in the printing direction and/or by a distance (x) found by the following equation in the direction perpendicular to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is the pitch of banks of the intaglio; n is an integer; $\theta$ is the angle of a screen made on the surface of the intaglio between the direction of the rotary shaft of the printing roll and the recesses as well as the banks of the diagonal or latticed screen of the intaglio.

Then, ink is supplied to the intaglio and similarly to the above-described manner, an ink film is formed on the projection of the printing roll. The projections and recesses of the ink transferred to the projection this time are reversed in phase to those of ink film which is still on the projection after the ink is transferred previously and the ink is transferred this time to compensate the projections and recesses of the ink film which has remained and indentations of the edge thereof.

Thereafter, the material is replaced with a new one, the printing roll contacts the material, an ink film on the projection is transferred to the material, and a smooth ink film is formed on the material.

Then, subsequent printing is carried out. The intaglio is returned to the original position, the intaglio contacts the printing roll, and as a result, ink is transferred from the intaglio to the printing roll. The projections and recesses of the ink film on the projection of the printing roll are reversed in phase and smooth without the gravure trace. Thereafter, the printing roll contacts a new material to be printed and consequently, a smooth ink film is formed on the material.

In this manner, the gravure trace is erased on the printing roll by repeating the movements of the intaglio an printing, the film on the printing roll is transferred to the material, and thus, thin films smooth on the surface thereof and clear in the pattern edge are formed on the material subsequently.

According to the thin film forming apparatus of the present invention, since the intaglio is moved in the printing direction and/or the direction perpendicular to the printing direction, a thin film smooth on its surface and preferable in the linearity of the edge is formed on the material by transferring ink so that the phase of the gravure mark is compensated.

BRIEF DESCRIPTION OF THE DRAWINGS

These and other objects and features of the present invention will become clear from the following description taken in conjunction with the preferred embodiments thereof with reference to the accompanying drawings. In these drawings;

FIG. 2(*b*) is a view showing the condition in which printing is carried out by displacing the intaglio to X-direction or Y-direction so that the trace of the bank is displaced ½ pitches;

FIG. 2(*c*) is a view showing a condition generated by performing printing twice;

FIG. 2(*d*) is a view showing a condition in which printing is carried out by displacing the intaglio to X-direction so that the trace of the bank is displaced (n+1/10);

BEST MODE FOR CARRYING OUT THE INVENTION

Figure 1A:
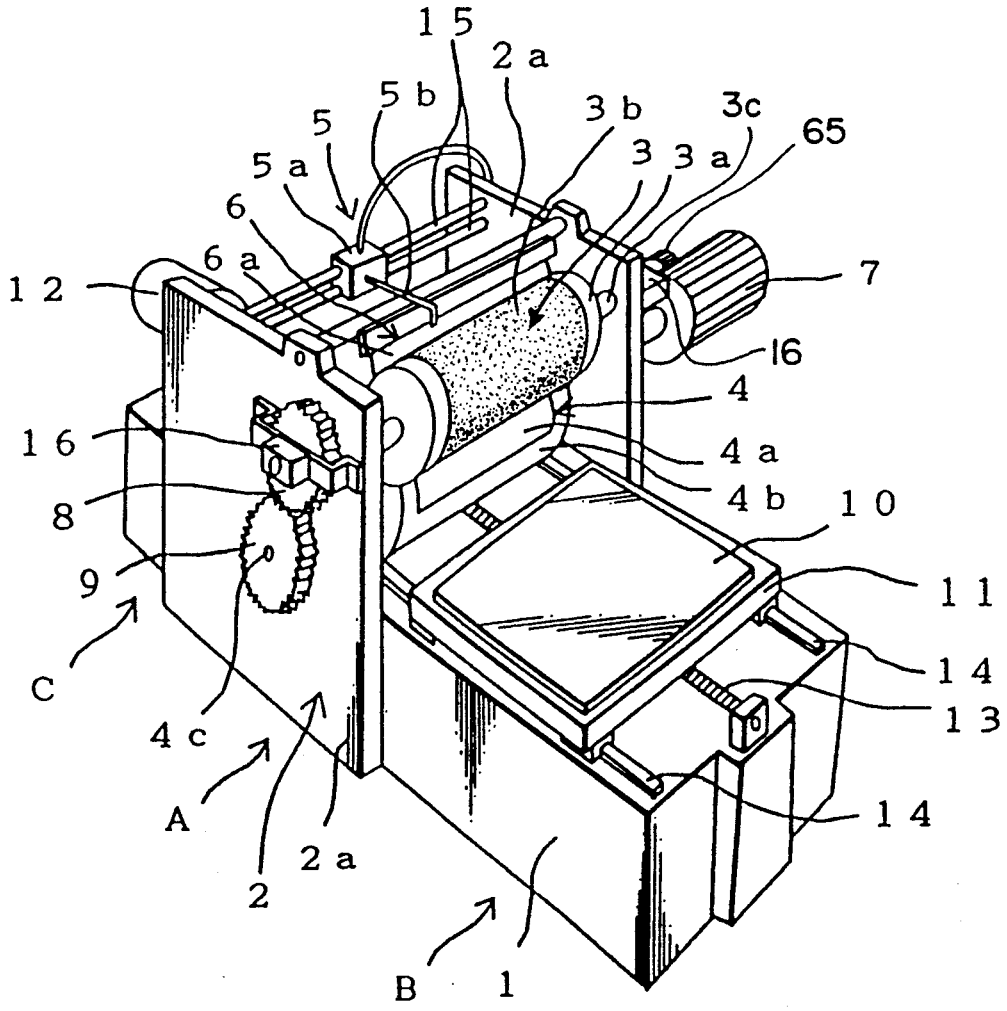
FIGS. 1(*a*), 1(*b*), and 1(*c*) are a perspective view, a principal portion-enlarged front view, a principal portion-enlarged side elevation, respectively showing a thin film forming apparatus according to a first embodiment of the present invention.

It is to be noted that like parts are designated by like reference numerals throughout the accompanying drawings.

FIRST EMBODIMENT

Figure 1B:
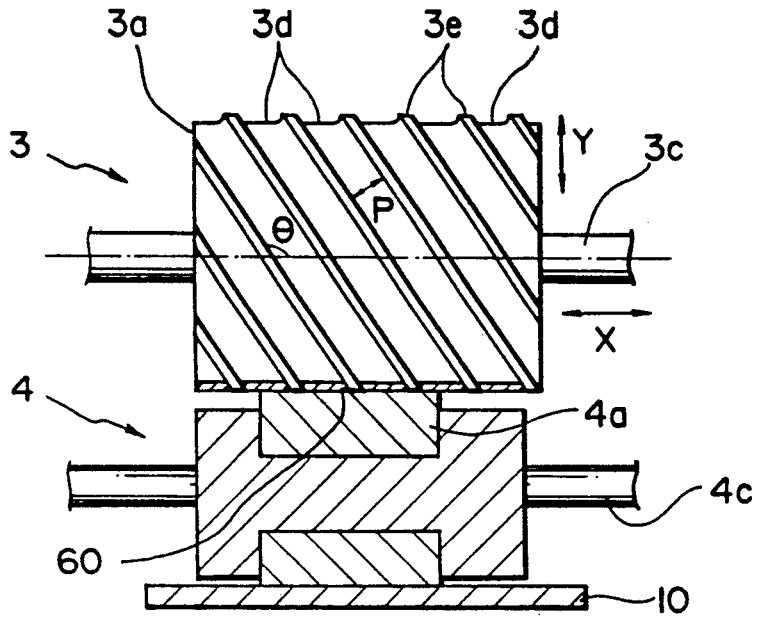
Figure 1C:
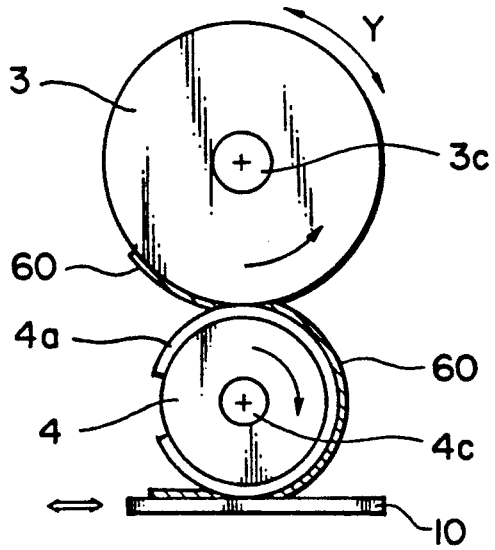
Figure 2A:
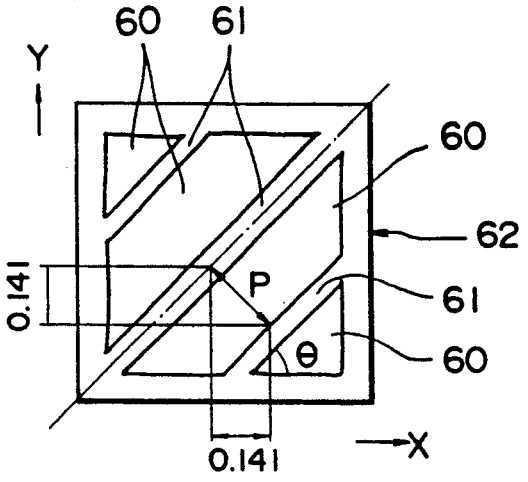
FIG. 2(*a*) is a view showing the pitch of banks of an intaglio and the relationship of angles made on the surface of the intaglio between the direction of the rotary shaft of a printing roll and projections and recesses of a screen in the initial printing condition.
Figure 2B:
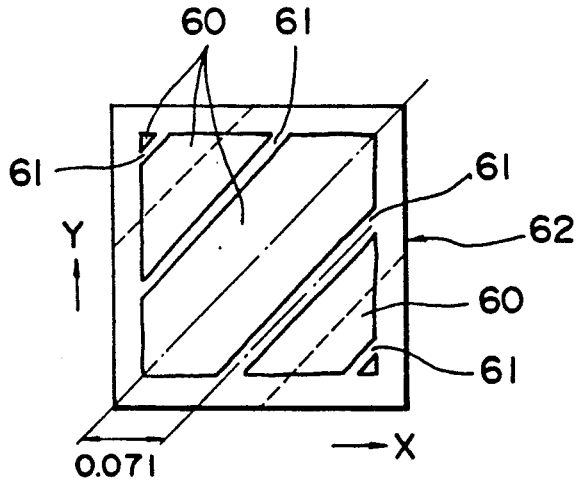
Figure 2C:
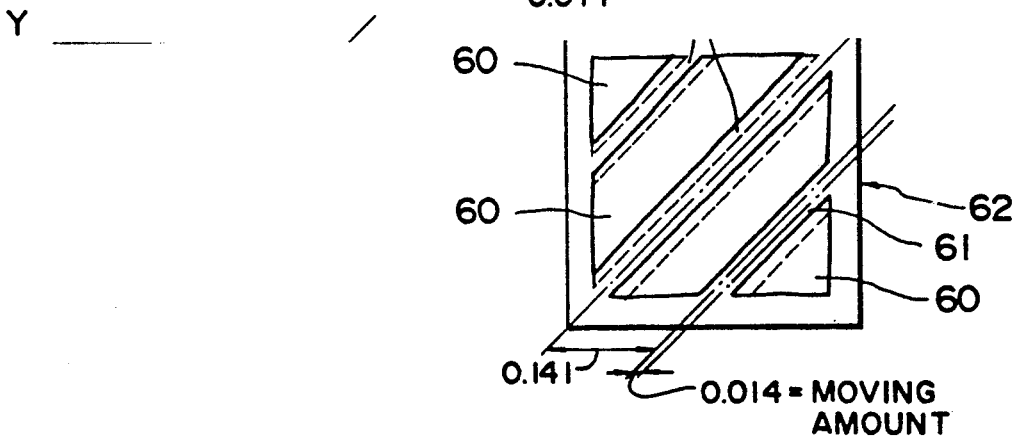

As shown in FIG. 1(*a*), in a thin film forming apparatus according to a first embodiment of the present invention, an ink supply device 5, a doctor 6, an intaglio roll 3, and a printing roll 4 are supported on a supporting frame 2 of a base 1. Due to the drive of a printing roll driving device, namely, due to the drive of a printing roll driving motor 7, the printing roll 4 and the intaglio roll 3 synchronously rotate based on the engagement between gears 8 and 9. There is movably placed on the base 1 positioned below the supporting frame 2 a material supporting surface plate 11, consisting of a rigid plate such as a glass plate, for placing thereon a material to be printed 10 on which a film is formed by printing. A ball thread 13 is rotated by a material supporting surface plate driving motor 12 so that while the material 10 fixedly placed on the surface plate 11 positioned on the base 1 is being moved between a printing position (A) and a material placing position (B), ink is supplied from the ink supply device 5 to the intaglio roll 3; an excessive amount of ink is scraped off by the doctor 6; ink of a predetermined pattern is transferred from the intaglio roll 3 to the printing roll 4; the printing roll 4 is then brought into contact with the surface of the material 10 placed at the printing position (A); and a thin film of a predetermined pattern is printed on the material 10.

In the supporting frame 2, a pair of supporting plates 2*a* is opposed to each other at a predetermined position of the center area of the base 1 consisting of a rectangular table. The supporting frame 2 having the pair of supporting plates 2*a* rotatably supports the intaglio roll 3 at the upper thereof and the printing roll 4 positioned diagonally below the intaglio roll 3. In the vicinity of the intaglio roll 3, there is fixed to an upper end portion of the supporting frame 2 the doctor 6 having a doctor blade 6*a* which slidably moves along the surface of the intaglio roll 3, thus scraping an excessive amount of ink from the intaglio roll 3.

The ink supply device 5 supplies ink from a position above the doctor blade 6*a* of the doctor 6 to the surface of the intaglio roll 3. In the ink supply device 5, a pair of rails 15 is provided on an upper end portion of the supporting frame 2 and opposite to the intaglio roll 3 with respect to the doctor 6, an ink supply member 5*a* is movably provided on the rails 15, and an ink nozzle 5*b* of the ink supply member 5*a* extends over the doctor 6 to a position above the surface of the intaglio roll 3. The ink supply member 5*a* is reciprocated along the pair of rails 15 by the drive of a motor or an air cylinder through a wire not shown, thus dropping ink onto the surface of the intaglio roll 3. The ink has a viscosity of approximately several tens to 30,000 c.p.s. and is a mixture including a synthetic resin or a resin precursor, a solvent, a filler, and an additive, etc.

The air cylinder not shown drives the doctor blade 6*a* of the doctor 6 between the position in which the doctor blade 6*a* slides on the surface of the intaglio roll 3 and the position in which the doctor blade 6*a* moves away therefrom. The leading end of the doctor blade 6*a* of the doctor 6 slides on the surface of the intaglio roll 3, thus spreading ink which has dropped onto the surface of the intaglio roll 3 over the surface of the intaglio roll 3 so as to charge the ink into recesses 3*b*.

Figure 3A:
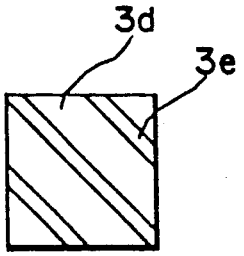
FIGS. 3(*a*) and 3(*b*) are plan views showing the pattern of each intaglio, respectively.
Figure 3B:
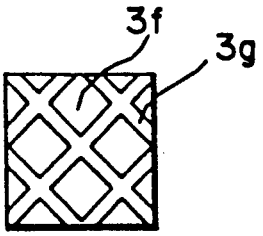
Figure 4A:
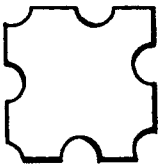
FIGS. 4(*a*) and 4(*b*) are plan views showing films formed by using the intaglios, respectively.
Figure 4B:
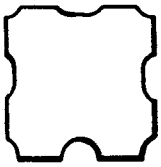
Figure 5A:
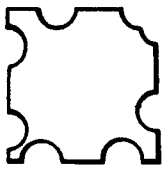
FIGS. 5(*a*) and 5(*b*) are plan views showing ink films transferred to the materials by a second time printing, respectively.
Figure 5B:
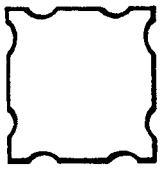
Figure 6A:
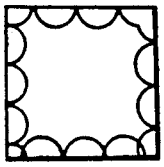
FIGS. 6(*a*) and 6(*b*) are plan views showing thin films formed by using the intaglios shown in FIGS. 3(*a*) and 3(*b*), respectively.
Figure 6B:
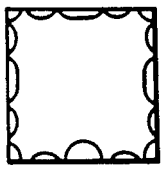
Figure 7A:
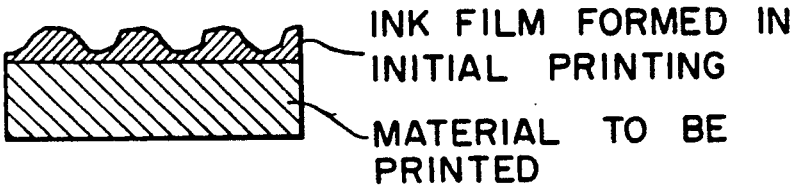
FIGS. 7(*a*), 7(*b*), and 7(*c*) are a sectional view showing the condition in which an ink film is formed on the surface of a material to be printed by a initial printing, a sectional view showing an ink film formed by a second time printing, and a sectional view in which the ink film formed by the second time printing is formed on the printed film formed by the initial printing.
Figure 7B:
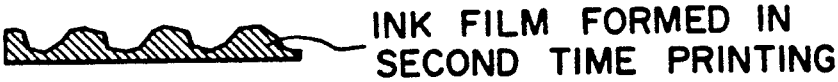
Figure 7C:
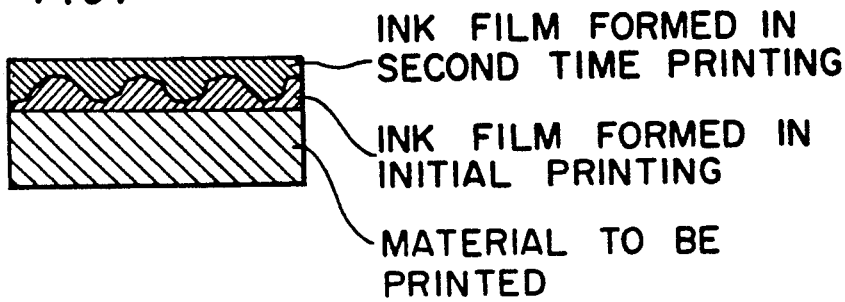
Figure 8:
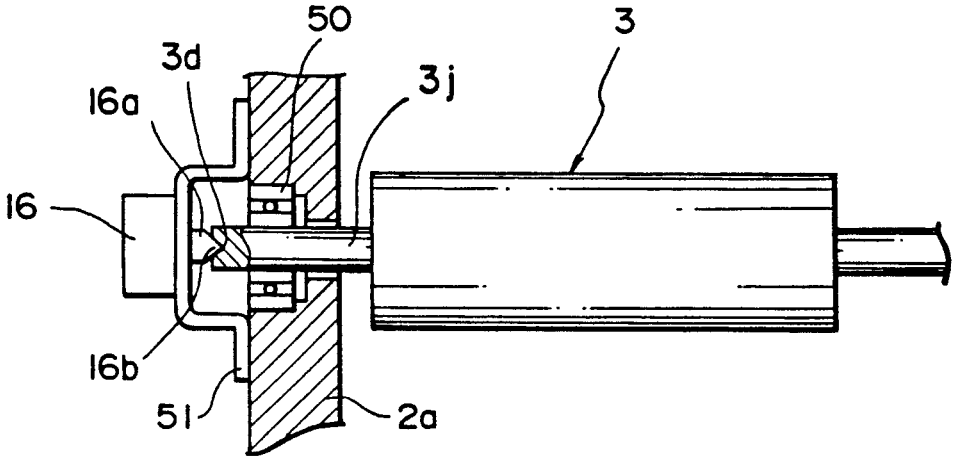
FIG. 8 is a front view partly in section showing the connection construction between a cylinder and an intaglio roll to be used in the thin film forming apparatus according to the first embodiment.

As shown in FIG. 1*b*, the intaglio roll 3 has a barrel 3*a* fixed to a rotary shaft 3*c*, and a plated layer is formed on the surface of the iron core of the barrel 3*a*, and as shown in FIG. 3, the surface of the plated layer of the barrel 3*a* has the recesses 3*b* consisting of a great number of grooves 3*d* or small openings 3*f*. The depth of each recess 3*b*, for example, ranges from five to several tens of micrometers. Projections 3*e* and 3*g* which are referred to as the bank previously are formed between adjacent grooves 3*d* and adjacent small openings 3*f*, respectively. A pair of pneumatically operated cylinders 16 mounted on the supporting frame is positioned at both ends of the rotary shaft 3*c*, and the cylinders 16 drive the intaglio roll 3 so that the intaglio roll 3 moves in the axial direction of the rotary shaft 3*c*, namely, in the direction perpendicular to the printing direction. That is, as shown in FIG. 8, the portion in the vicinity of each end of the rotary shaft 3*c* of the intaglio roll 3 is rotatably supported by each supporting plate 2*a* through a bearing 50; a spherical recess 3*j* is formed on the end surface of the rotary shaft 3*c*; the cylinders 16 are mounted on the rotary shaft 3*c* of the intaglio roll 3 supported by each supporting plate 2*a* via a bracket 51; and a spherical projection 16*b* positioned at the leading end of the piston rod 16*a* of the cylinder 16 contacts the spherical recess 3*j* of the rotary shaft 3*c*. Thus, the rotary shaft 3*c* is supported so that the rotation thereof is not prevented. When the rod 16*a* of each cylinder 16 is moved on each rotary shaft 3*c* in one direction, the rotary shaft 3*c* is pressed and forcibly moved along the above-described one direction. According to the design of the present invention, when the piston rod 16*a* of one of the cylinders 16 is pressing one end of the rotary shaft 3*c*, the piston rod 16*a* of the other cylinder 16 is pressed. The barrel 3*a* supported by the rotary shaft 3*c* is arranged so that the barrel 3*a* is capable of contacting a projection 4*a* of a barrel 4*b* of the printing roll 4 at a predetermined pressure. The first gear 8 projects from the supporting frame 2 of the rotary shaft 3*c* and is fixed between the cylinders 16 and the supporting frame 2. The first gear 8 is a spur gear abraded with a high accuracy and the face width thereof has a distance in such an extent that the intaglio roll 3 moves axially, and consequently, the first gear 8 does not prevent the axial movement of the rotary shaft 3*c*, of the intaglio roll 3, on which the first gear 8 is mounted. In order to move the intaglio roll 3 in the axial direction of the rotary shaft 3*c*, the cylinder 16 may be provided at only one end of the rotary shaft 3*c* and the other cylinder 16 may be replaced with a spring so as to urge the other end of the rotary shaft 3*c* axially.

Figure 9:
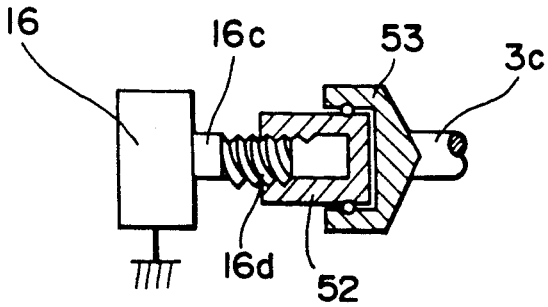
FIGS. 9 and 10 are sectional views showing cylinders according to another embodiment.
Figure 10:
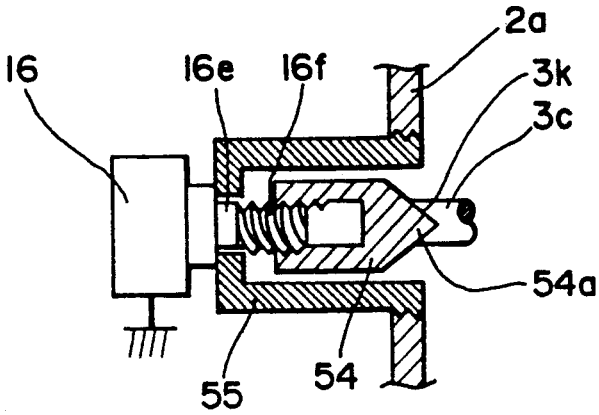

The arrangement of the cylinder 16 is not limited to that shown in FIG. 8. As shown in FIG. 9, a precision screw 16*d* may be defined on a piston rod 16*c* of the cylinder 16, an adjusting barrel 52 may be mounted on each end of the rotary shaft 3*c* through a bearing 53 so that a screw formed on the internal surface of the recess of the barrel 52 engages the precision screw 16*d* of the piston rod 16*c*. In this case, the rotational force of the rotary shaft 3*c* is not transmitted to the barrel 52 by the bearing 53, and the force applied by the piston rod 16*d* to the rotary shaft 3*c* can be adjusted by rotating the barrel 52. In this case, when the piston rod 16*c* of one of the cylinders 16 is pressing one end of the rotary shaft 3*c*, the piston rod 16*c* of the other cylinder 16 is capable of pulling the other end of the rotary shaft 3*c*. As shown in FIG. 10, in order to control the movement distance of the cylinders 16, it is possible that an adjusting coupling 54 engages a screw 16*f* positioned at the leading end of a piston rod 16*e* and that a spherical projection 54*a* positioned at the leading end of the adjusting coupling 54 is inserted into a spherical recess 3*k* positioned at each end of the rotary shaft 3*c* so as to rotatably support the rotary shaft 3*c*. In FIG. 10, reference numeral 55 denotes a bracket, fixed to the supporting plate 2*a*, for supporting the cylinders 16. The rotational position of the intaglio roll 3, for example, is detected by an encoder 65 mounted on an end portion of the rotary shaft 3*c* of the intaglio roll 3 and the drive of the intaglio roll 3 is controlled by a servo motor by providing a control pulse oscillating circuit. Thus, the intaglio roll 3 is rotated after controlling the positioning in the printing direction with a high accuracy.

In the printing roll 4, the barrel 4*b* is fixed to a rotary shaft 4*c* and there is provided at a predetermined position of the peripheral surface of the barrel 4*b* the elastic projection 4*a* consisting of rubber such as butyl rubber, a synthetic resin such as nylon group resin, a photosensitive rubber, a photosensitive resin, or the like. Ink is transferred from the intaglio roll 3 to the projection 4*a*. A desired pattern corresponding to the pattern of a thin film to be formed on the surface of the material is formed on the projection 4*a*. Both ends of the rotary shaft 4*c* are rotatably supported by the supporting plates 2*a*, and the second gear 9 is fixed to one end of the rotary shaft 4*c* projecting outward from one of the supporting plates 2*a* of the supporting frame 2. The second gear 9 is a spur gear abraded with a high accuracy and engages the first gear 8. The printing roll driving motor 7 projecting outward from the other supporting plate 2*a* of the supporting frame 2 is connected with the other end of the rotary shaft 4*c* of the printing roll 4, namely, the other end at which the second gear 9 is not fixed. Accordingly, when the printing roll driving motor 7 drives the printing roll 4 to rotate the printing roll 4, the intaglio roll 3 and the printing roll 4 rotate synchronously due to the engagement between the second gear 9 and the first gear 8. The motor 7 may be connected with the intaglio roll 3 instead of being connected with the printing roll 4 so as to transmit the rotational force of the rotary shaft 3*c* of the intaglio roll 3 to the printing roll 4 through a similar connecting mechanism having gears. In addition, the printing roll 4 and the intaglio roll 3 may be driven by different motors.

As shown in FIG. 1(*a*), the surface plate 11 is placed on the base 1. A pair of guiding rails 14 is fixed to the upper surface of the base 1 such that the rails 14 extend through both sides of the printing position (A) located below both supporting frames, the material placing position (B) located below both supporting frames and on the material feed-in side, and a feed-out position (C) located below both supporting frames and on the material feed-out side. The surface plate 11 engages the rails 14 and moves between each position (A) and (C) along the rails 14 on the base 1. The material 10 is placed on the surface plate 11 at a predetermined position thereof and retained thereon. At the center of the upper surface of the a base 1, the ball thread 13 extending in the longitudinal direction of the base 1 is rotatably connected with a gear (not shown) formed on the lower surface of the surface plate 11 and connected with the material driving motor 12 at one end thereof, and the driving motor 12 rotates the ball thread 13 in both ways so as to reciprocate the surface plate 11 along the rails 14 on the base 1. The material 10 contacts the printing roll 4 at the printing position (A) of the surface plate 11 and ink of a desired pattern of the projection 4*a* of the printing roll 4 is transferred to the material 10 so as to print the desired pattern on the material 10.

The concrete formation of a thin film by using the thin film forming apparatus of the above-described construction is considered. For example, an intaglio having a latticed screen in which the pitch of the bank p=0.127 mm, the width of the bank =0.02 mm, screen angle $\theta=45°$, and the depth of the recess =20 μm is used. A glass substrate of 300×300×1.1 mm is used as the material 10 to perform printing.

First, ink is supplied from the ink supply device 5 to the surface of the intaglio roll 3. A solution of acrylic group resin, for example, is used as ink. Extra amount of ink is removed by the doctor blade 6*a* which slides on the intaglio roll 3 and a certain amount of ink is charged into the recess 3*b* of the intaglio roll 3 and held therein.

Next, the intaglio roll 3 and the printing roll 4 contact with each other to transfer ink charged in the recess 3*b* of the intaglio roll 3 to the projection 4*a* of the printing roll 4.

Then, the material 10 is placed on and retained by the surface plate 11 which slides on the base 1 positioned below the printing roll 4, and the surface plate 11 contacts the printing roll 4 at the printing position (A) immediately below the printing roll 4. That is, the printing roll driving motor 7 is driven for rotation when the surface plate 11 is at the material placing position (B), the intaglio roll 3 is rotated through the second gear 9 and the first gear 8 with the rotation of the printing roll 4, and in synchronization with the rotation of the printing roll 4, the surface plate 11 moves to the feed-out position (C) through the printing position (A) according to the rotation of the ball thread 13. Thus, the ink of the desired pattern of the projection 4*a* of the printing roll 4 is transferred onto the material 10. At this time, the gravure trace is reproduced on the ink film which has regular projections and recesses and the pattern edge having indentations.

Thereafter, the cylinders 16 are operated to move the intaglio roll 3 by 0.988 mm in the direction perpendicular to the printing direction, namely, the axial direction of the rotary shaft 3*c*. The movement distance is found by the following equation.

$$n + 1/2 = (x/p)\sin\theta$$

$$\begin{aligned} x &= \operatorname{cosec}\theta \times p \times (n + 1/2) \\ &= \operatorname{cosec}45 \times 0.127 \times 5.5 \quad (n = 5) \\ &= 0.988 \end{aligned}$$

Then, the material 10 is returned to the original position. That is, the printing roll driving motor 7 is reversely rotated when the surface plate 11 is at the feed-out position (C) so as to move the surface plate 11 from the feed-out position (C) to the material placing position (B) through the printing position (A).

Then, a second time printing is carried out. Ink is supplied to the intaglio roll 3 and similarly to the initial printing, an ink film is formed in approximately the same portion of the material 10. The position and phase of projections and recesses of the gravure trace of ink transferred to the projection 4*a* of the printing roll 4 and the material 10 at this time are reversed to those of projections and recesses of the ink transferred in the initial printing.

The printed glass substrate is dried at 70° C. for 10 minutes in a clean oven serving as a heating drier and having no dust therein and then, heated at 200° C. for thirty minutes and as a result, a 1.0 μm thin film smooth on the surface thereof and preferable in linearity in the edge of the pattern is formed on the material 10.

SECOND EMBODIMENT

Figure 11:
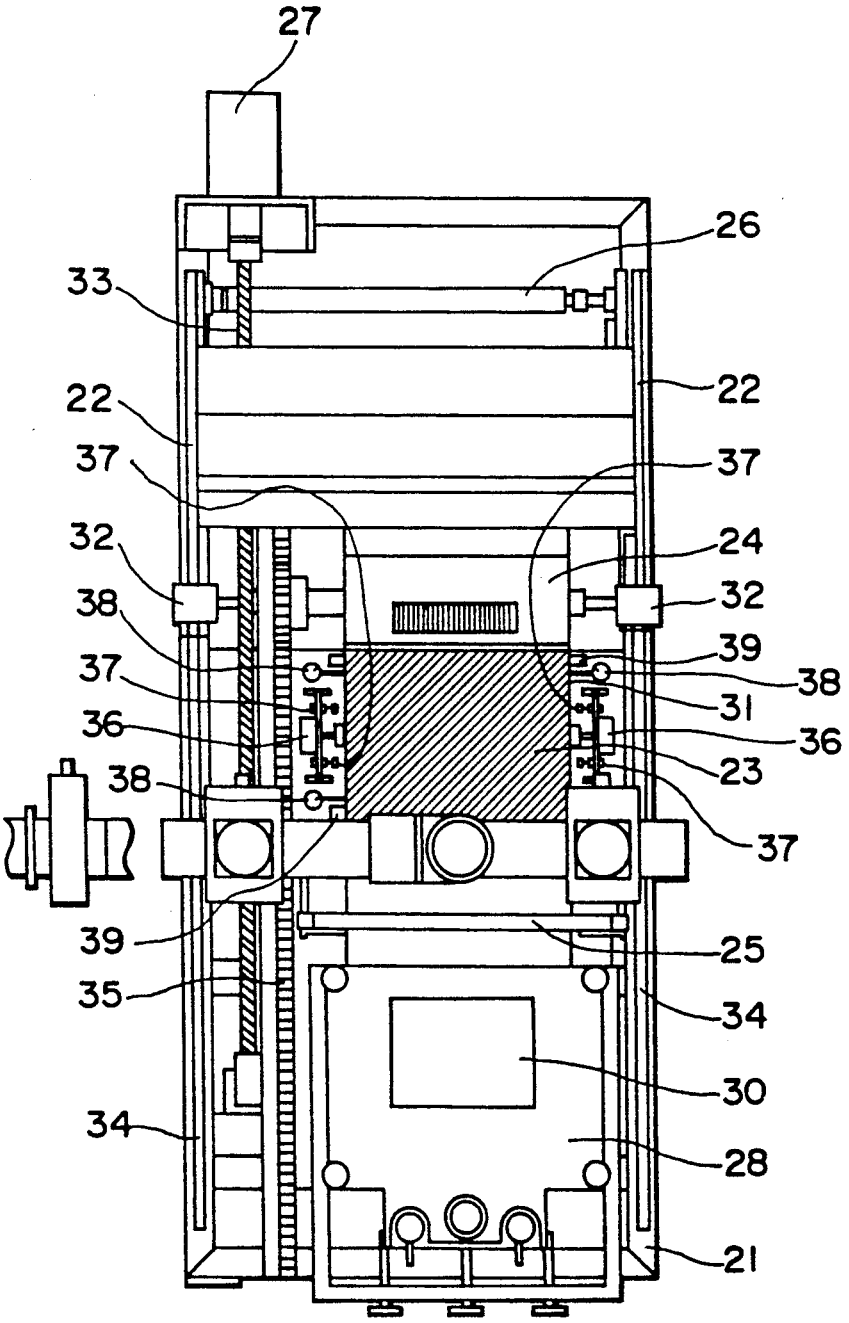
FIGS. 11 through 13 are a plan view, a side elevation, and a front view showing a thin film forming apparatus according to a second embodiment of the present invention, respectively.
Figure 12:
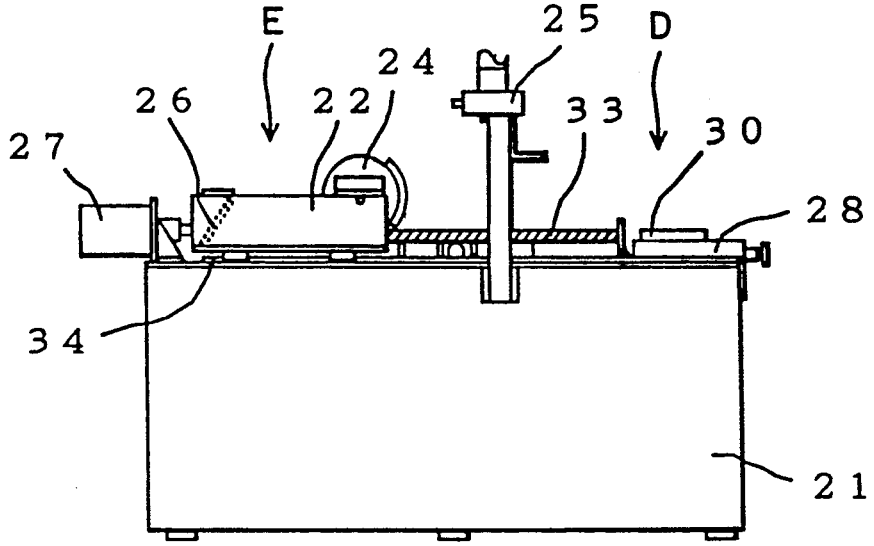
Figure 13:
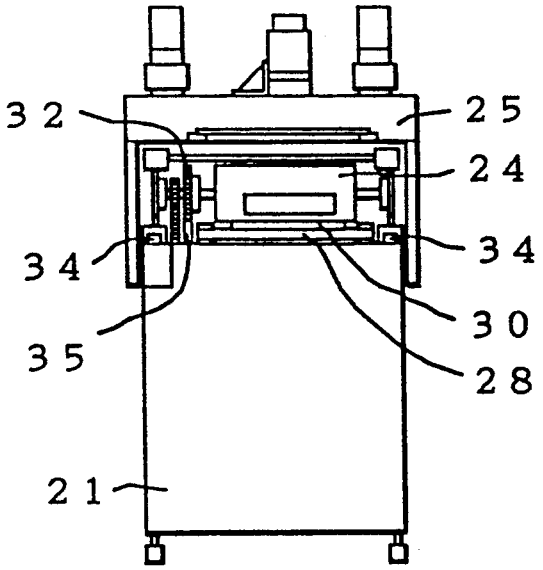
Figure 14:
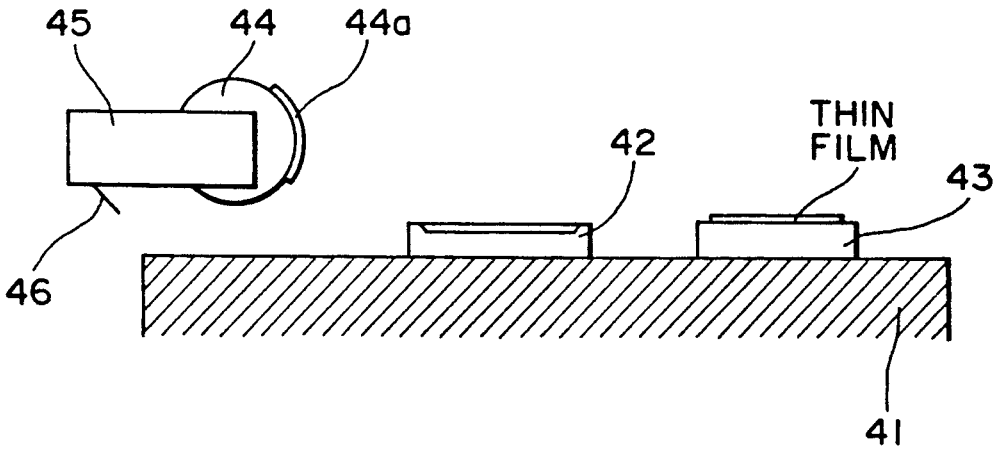
FIG. 14 is an explanatory view showing a conventional thin film forming apparatus.

In the first embodiment, the intaglio is roll-shaped and the material is moved with respect to the printing roll, but in a second embodiment as shown in FIGS. 11 through 13, the intaglio may be formed in plate-shaped and the printing roll may be moved with respect to the material. In FIGS. 11 through 13, there are provided an intaglio supporting surface plate 31 supporting a flat intaglio 23 on a base 21 and movable horizontally, a material supporting surface plate 28 which retains a material to be printed 30 thereon, and a pair of supporting frames 22 which supports a printing roll 24 and a doctor 26.

The pair of supporting frames 22 moves on a pair of linear guides 34 provided on the base 21 due to the drive of a driving motor 27 and a ball thread 33. At this time, the printing roll 24 is driven for rotation through a rack 35 and a pinion gear 32 provided on the base 21. The printing roll 24 is vertically movable and when it moves downward, a projection 24*a* consisting of an elastic member formed on the side surface of the printing roll 24 and having a desired pattern formed thereon rotates in synchronization with the moving speed of the pair of supporting frames 22 while the projection 24*a* is in contact with the intaglio 23 or the material 30. Ink is supplied from an ink supply unit 25 to the intaglio 23 and then, when the pair of supporting frames 22 move from a printing position (D) to an ink supply position (E), the doctor blade of the doctor 26 slides on the intaglio 23, thus charging ink into recesses 23*b* of the intaglio 23 and removing an excessive amount of ink therein. During this period, the printing roll 24 is at the upward movement position and does not contact the intaglio 23. According to the movement of the pair of supporting frames 22 from the ink supply position (E) to the printing position (D), the printing roll 24 which has moved downward from the upward movement position rotates synchronously with the supporting frames 22, and a projection 24*a* of the printing roll 24 transfers ink to the surface of the projection 24*a* successively while the projection 24*a* is in contact with the intaglio 23 and then, the projection 24*a* rotates in contact with the material 30 placed on the material supporting surface plate 28, thus transferring ink of a desired pattern to the material 30.

The surface plate 31 supporting the intaglio 23 is mounted to be movable in the direction perpendicular to the printing direction, namely, X-direction. That is, the surface plate 31 is mounted on the base 21 so that the surface plate 31 is movable along the axial direction of a pair of linear guides 39 fixed to the base 21 along the direction perpendicular to the printing direction. A pair of pneumatic cylinders 36 for moving the surface plate 31 as necessary is connected with the surface plate 31, and based on a signal outputted from a control device, the surface plate 31 is moved along the linear guides 39 by the drive of the pair of pneumatic cylinders 36. The movement distance of the surface plate 31 is adjusted by four adjusting bolts 37 serving as stoppers for regulating its movement and four detecting dial gauges 38. In the second embodiment, a mechanism similar to the moving mechanism for moving the surface plate 31 in X-direction may be provided to move the surface plate 31 in the printing direction, namely, Y-direction. Instead of moving the surface plate 31 in X-direction or Y-direction, the material 30 may be moved in X-direction or Y-direction by a mechanism similar to that for moving the surface plate 31.

For example, an intaglio having a diagonal screen having the following specification formed thereon is used as the intaglio 23: the bank pitch is 0.5 mm, recess width-to-bank width ratio =470:30, screen angle $\theta=60°$, and recess depth is 20 μm. As ink, a solution (SE-100) containing polyamic acid at the concentration of 15% (manufactured by Nissan Chemical Industries, Ltd.) is used. A glass substrate of 300×220×1.1 mm, for example, is used as the material 30. For example, using the printing roll 24 having a desired pattern of line width: 0.30 mm, pitch: 0.90 mm, line length: 150 mm, and the number of lines 240 on the projection thereof, the ink charged into the intaglio 23 is transferred to the projection 24*a*, then, the ink is transferred to the glass substrate to carry out a initial printing.

Next, the intaglio 23 is moved 0.867 mm in the direction perpendicular to the printing direction. The moving distance is found by the following equation:

$$\begin{aligned} x &= \operatorname{cosec}\theta \times p \times (n + 1/2) \quad (n = 1) \\ &= 0.867 \end{aligned}$$

Then, with the movement of the pair of the supporting frame 22, ink is charged into the intaglio 23 and a second time printing is carried out on the same glass substrate similarly to the initial printing.

The printed glass substrate is dried in a clean oven at 70° C. for 10 minutes and then, heated at 170° C. for an hour to harden the ink. As a result, a striped polyimide thin film 0.8 μm thick, smooth on the surface thereof, and clear in the edge of the pattern is formed on the material 30.

Although the present invention has been fully described in connection with the preferred embodiments thereof with reference to the accompanying drawings, it is to be noted that various changes modifications are apparent to those skilled in the art. Such changes and modifications are to be understood as included within the scope of the present invention as defined by the appended claims unless they depart therefrom.

What is claimed is:

1. A thin film forming apparatus comprising:

an intaglio roll (3) rotatably supported by a supporting frame (2) of a base (1) and having a screen having a great number of diagonal or latticed regular recesses (3*b*, 3*d*, 3*f*) on a surface thereof;

a doctor (6), mounted on the supporting frame (2) at a predetermined position in a periphery of the intaglio roll (3), for spreading ink supplied to the intaglio roll (3) on the surface of the intaglio roll (3) so that a certain amount of ink is held in the recesses (3*b*, 3*d*, 3*f*);

a printing roll (4) adjacent to the intaglio roll (3), rotatably supported by the supporting frame (2), rotatable in synchronization with the intgalio roll (3), having a desired pattern, capable of contacting the surface of the intaglio roll (3), and having a projection (4*a*) to which the ink held in the recesses (3*b*, 3*d*, 3*f*) of the intaglio roll (3) is transferred when the printing roll (4) contacts the surface of the intaglio roll (3);

a surface plate (11) for placing and retaining a material to be printed (10) thereon and capable of reciprocatively moving on the base (1) synchronously with a peripheral speed of the printing roll (4) between a printing position (A) at which the material (10) contacts the printing roll (4) and a position (B, C) spaced from the printing roll (4);

a driving device (7) for driving the intaglio roll (3) and the printing roll (4);

a surface plate driving device (12, 13, 14) for moving the surface plate (11) between the printing position (A) and the position (B, C) spaced from the printing roll (4); and an intaglio roll moving device (16, 7, 65) for moving the intaglio roll (3) by a distance (y) found by the following equation in a printing direction and/or by a distance (x) found by the following equation in a direction perpendicular to the printing direction:

$$n + \frac{1}{5} \leqq \left| \frac{x}{p} \sin\theta \right| \leqq n + \frac{4}{5}$$

$$n + \frac{1}{5} \leqq \left| \frac{y}{p} \cos\theta \right| \leqq n + \frac{4}{5}$$

where p is a pitch of banks (3*e*, 3*g*) of the intaglio roll (3); n is an integer; $\theta$ is an angle of a screen made on the surface of the intaglio roll (3) between a direction of a rotary shaft of the printing roll (4) and the recesses (3*b*, 3*d*, 3*f*) as well as the banks (3*e*, 3*g*) of the diagonal or latticed screen of the intaglio roll (3).

2. A film forming apparatus as claimed in claim 1, wherein the driving device (7) drives the intaglio roll (3) through the printing roll (4) to rotate the intaglio roll.

3. A thin film forming apparatus comprising:

a flat intaglio (23) supported on a base (21) and having a screen having a great number of diagonal or latticed regular recesses on a surface thereof;

a doctor (26), mounted on a supporting frame (22) in a periphery of the intaglio (23) at a predetermined position thereof, for spreading ink supplied to the intaglio (23) on the surface of the intaglio (23) so that a certain amount of ink is held in a recess (23*b*) of the intaglio (23);

a printing roll (24) rotatably supported on the supporting frame (22) and positioned above the intaglio (23), having a desired pattern and a projection (24*a*) capable of contacting the intaglio (23), transferring the ink held in the recess (23*b*) of the intaglio (23) to the projection (24*a*) when the projection (24*a*) contacts the intaglio (23) under pressure while the printing roll (24) is rotating;

a surface plate (28) mounted on the base (21), placing and retaining a material to be printed (30) thereon so that the projection (24*a*) of the printing roll (24) contacts a surface of the material (30), and transferring ink present on the projection (24*a*) to the material (30) when the projection (24*a*) contacts the material (30) under pressure while the the printing roll (24) is rotating;

a driving device (32, 35) for rotating and moving the printing roll (24);

a device (36, 39) for moving the intaglio (23) by a distance (y) found by the following equation in a printing direction and/or by a distance (x) found by the following equation in a direction perpendicular to the printing direction:

$$n + \frac{1}{5} \leqq \left| \frac{x}{p} \sin\theta \right| \leqq n + \frac{4}{5}$$

-continued $$n + \frac{1}{5} \leqq \left| \frac{y}{p} \cos\theta \right| \leqq n + \frac{4}{5}$$

where p is a pitch of banks of the intaglio (23); n is an integer; $\theta$ is an angle of a screen made on the surface of the intaglio (23) between a direction of a rotary shaft of the printing roll (24) and the recess as well as the banks of the diagonal or latticed screen of the intaglio (23).

* * * * *